US005108561A

United States Patent [19]

Kuromatsu

[11] Patent Number: 5,108,561

[45] Date of Patent: Apr. 28, 1992

[54] METHOD OF DRESSING, DRESSING SYSTEM AND DRESSING ELECTRODE FOR CONDUCTIVE GRINDSTONE

[75] Inventor: Akio Kuromatsu, Kanagawa, Japan

[73] Assignee: Applied Magnetic Lab Co., Ltd., Yokohama, Japan

[21] Appl. No.: 624,215

[22] Filed: Dec. 10, 1990

[30] Foreign Application Priority Data

Dec. 21, 1989 [JP] Japan ..... 1-332416

[51] Int. Cl.[5] ..... C25F 7/00; B23H 5/08; B23H 5/10

[52] U.S. Cl. ..... 204/129.46; 204/217

[58] Field of Search ..... 204/129.46, 217

[56] References Cited

U.S. PATENT DOCUMENTS 4,013,526 3/1977 Inoue ..... 204/129.46
4,849,599 7/1989 Kuromatsu ..... 204/129.46 X
4,956,056 9/1990 Zubatova et al. ..... 204/129.46 X

FOREIGN PATENT DOCUMENTS 2917910 11/1979 Fed. Rep. of Germany ..... 204/129.46
1114509 9/1984 U.S.S.R. ..... 204/129.46
763109 12/1956 United Kingdom ..... 204/217

*Primary Examiner*—Donald R. Valentine
*Attorney, Agent, or Firm*—Lowe, Price, LeBlanc & Becker

[57] ABSTRACT

A method of dressing for a conductive grindstone, a dressing system for this method and a dressing electrode used in this method. According to the preferred embodiment, this method comprises reciprocating a dressing electrode, which is formed of a metal having large chemical affinity with the super abrasive grains of the grindstone, in a direction being vertical to the moving direction of the grindstone, while the electrode is brought into contact with the ground surface of the grindstone with a predetermined pressure and applying a voltage between the electrode and the grindstone so as to provide a positive pole on the grindstone, while a conductive processing fluid is flown on the portion of the electrode contacting with the grindstone. Therefore, electrochemical action, chemical action, mechanical operation and electro-discharge operation are cooperated in a dressing process.

5 Claims, 1 Drawing Sheet

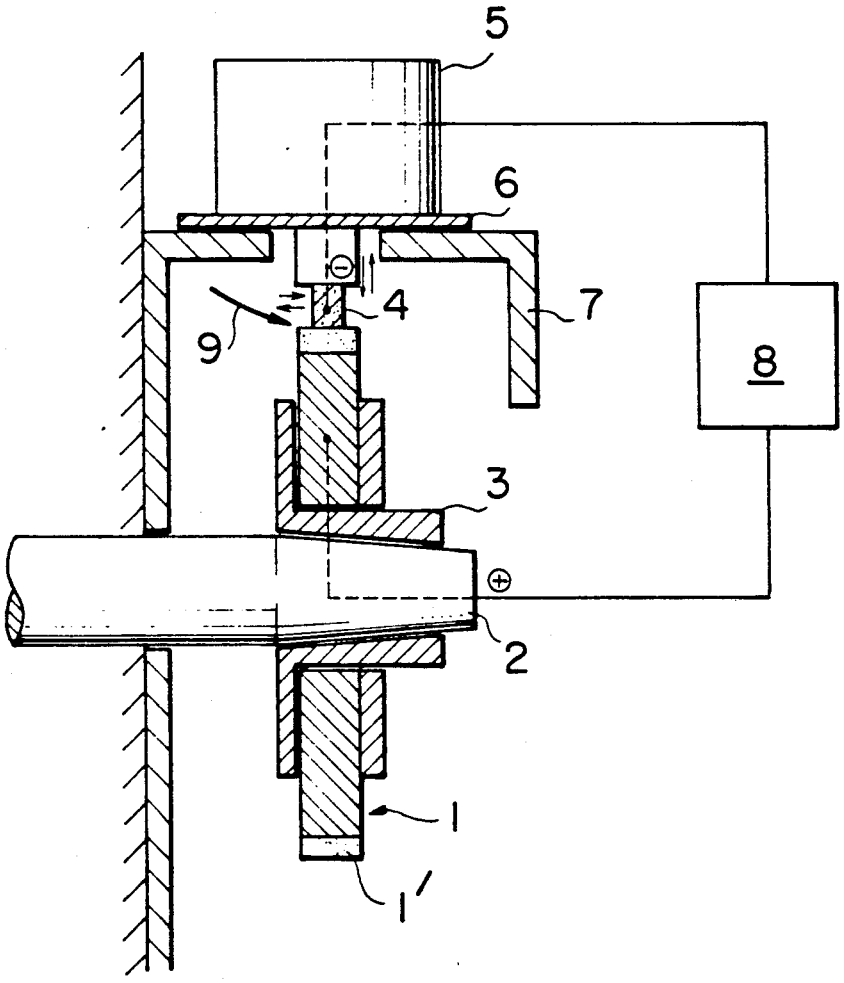
5
6
7
4
9
8
3
2
1
1'

METHOD OF DRESSING, DRESSING SYSTEM AND DRESSING ELECTRODE FOR CONDUCTIVE GRINDSTONE

BACKGROUND OF THE INVENTION

1. Field of the Invention

This invention relates to a method of dressing, dressing system and dressing electrode for a conductive grindstone, particular for a conductive grindstone using super abrasive grains such as diamonds, CBN and the like, and more particularly to the method of performing dressing and trueing processes for the above mentioned grindstone and dressing system and the novel dressing electrode for carrying out this method.

2. Prior Art

Dressing and trueing for a normal grindstone using green-carborundom, alundom and the like as abrasive grains is generally carried out as follows. First, the grindstone is formed to be a discshape and rotated. Then, a diamond dresser using one or many diamond abrasive grains is pressed against the ground surface of the grindstone. Simultaneously, either the grindstone or the dresser is reciprocated in a direction being parallel to the rotating shaft of the disc.

However, it is impossible or extremely difficult to perform the dressing process for a grindstone using super abrasive grains such as diamond, CBN and the like with the above mentioned method' because, the super abrasive grains of the grindstone are much harder than the green-carborundom, alundom. Additionally, the diamond used as super abrasive grains is often worn out due to the heat generated during the dressing process.

Therefore, the grindstone is ground with a steel, which is not quenched to be so-called raw material, for long time. A brake dresser also can be used while it is rotating during the dressing process. These methods can be used effectively for resin bond or glass bond grindstones using super abrasive grains to some degree. However, with these methods, it takes an extremely long time to perform the dressing process particularly the trueing process for the metal bond grindstones using super abrasive grains where the super abrasive grains are bonded surely, thus, these methods can not be utilized at all for the above mentioned grindstones.

Lately, an electrolytic dressing method of the dressing and trueing processes for the metal bond grindstones using super abrasive grains has become practical.

This dressing method is performed for the metal bond grindstone which is used in a cutting or grinding process. First, a dressing electrode formed of black lead, rustless steel, copper alloy and the like is disposed adjacent the peripheral face (ground surface) of the grindstone so that there is a predetermined gap between the electrode and the grindstone. Then, while a conductive processing fluid is supplied to the gap, a voltage is applied between the electrode and the grindstone so as to provide a positive pole on the grindstone. Shavings and/or bond metal of the grindstone, which are attached to the surface of the grindstone during the cutting or grinding process, are melted with electrolytic action. Thus, the metal bond grindstone can be ground. However, in this electrolytic dressing method, there are various problems as follows.

1. During the dressing process for the ground surface of the grindstone, the distance of the gap between the dressing electrode and the grindstone becomes inconsistent due to the difference of the ejected length of the abrasive grains from the ground surface of the grindstone and the difference of the amount of accumulated shavings and the like on this surface. Then, the electrolytic action can not be applied to the whole of this surface uniformly. Therefore, this surface facing the dressing electrode is deformed asymmetrically with respect to the center line of this surface. That is to say, "geometric distortion" is caused on this surface. If the grindstone is used for cutting a workpiece, the grindstone is often deformed during the cutting process due to this "geometric distortion", whereby the workpiece can not be cut straightly. Additionally, the grindstone is bent backward due to this "geometric distortion", which is a critical defect for the cutting grindstone. As a result, it is impossible to precisely cut workpieces. When a grindstone is used for grinding a workpiece, the grindstone generally has a width (thickness) in the direction parallel to the rotating shaft of the grindstone. In this case, due to this "geometric distortion", the ground surface can not remain smooth during the grinding process. As a result, it is impossible to grind the workpiece precisely with the conventional electrolytic dressing method.

2. In the trueing process for the grindstone, the ground surface of the grindstone should be shaved enough so that a considerably large amount of shavings are removed. In this conventional electrolytic dressing method, during the dressing process for the grindstone, an insulating layer preventing the electrolytic action is produced on the ground surface. Thus, the voltage for the dressing process is decreased. Consequently, corresponding to the decreasing of the dressing voltage, the trueing speed gradually approaches zero. Finally, the trueing process is substantially stopped. Although all of the bond metal and shavings must be melted by this action for finishing the dressing process, the abrasive grains can not be removed completely from the grindstone since this method is progressed only by this electrolytic action. Therefore, even if long time is taken, the trueing process can not be performed substantially with the conventional electrolytic dressing method.

SUMMARY OF THE INVENTION

It is therefore the object of the present invention to provide an effective dressing method, a dressing system and a dressing electrode which utilize the advantages of the both conventional mechanical dressing methods and electrolytic dressing methods and eliminate the disadvantages thereof for a conductive grindstone such as a metal bond grindstone as well as a resin bond and a glass bond grindstone.

In other words, it is the object of the present invention to provide the dressing method, the dressing system and the dressing electrode, by the which mechanical operation together with electrolytic action are carried out, by which electrical and chemical actions are utilized on the basis of a novel idea obtained by paying attention to the properties of the super abrasive grains, which permits an efficient dressing process without "geometric distortion" for progressing the grinding ability of the grindstone and by which also a trueing process can be carried out efficiently and surely.

Now, it will be described how the present invention came about.

1. The inventor paid attention to the properties of the conventional electrolytic dressing process, particularly to the progressed grinding ability of the electrolytic dressing process for the conductive grindstone using abrasive grains. Then, the inventor continued study for utilizing this ability.

First, the inventor investigated and analyzed the causes of the "geometric distortion". Then, the inventor found the following facts;

As explained before, during the dressing process, the surface facing the dressing electrode is deformed asymmetrically with respect to the center line of this surface. Accordingly, electrolytic action is applied to the ground surface unevenly, in the direction parallel to the rotating shaft of the grindstone, causing "geometric distortion".

The inventor recognized that during the dressing process, if the dressing electrode is reciprocated in the direction parallel to the rotating shaft of the grindstone, the asymmetrical deformation with respect to the center line of the ground surface of the grindstone can be eliminated thereby preventing the "geometric distortion" of the grindstone.

2. Next, the inventor investigated and analyzed the causes of difficulty of the trueing process for the grindstone in the conventional electrolytic dressing method. Then, the inventor found the following facts;

During the dressing process for the grindstone, the bond metal is melted with the electrolytic action so that each ejected height of each abrasive grain is increased. Accordingly, the length of the gap between the dressing electrode and the peripheral surface of the grindstone is increased so that dressing current can not flow in the gap. Alternatively, as the electrolytic action is progressed, the insulating layer preventing the electrolytic action is formed on the surface of the grindstone. Accordingly, the dressing current flowing in the gap is decreased.

3. Further, the inventor understood the following things:

As the bond metal is melted, the abrasive grains are projected from the ground surface of the grindstone. When the projected abrasive grains are efficiently worn out, the above mentioned increasing of the length of the gap and the decreasing of the dressing current are prevented, thus the trueing process can be carried out efficently.

The inventor investigated and analyzed abrasion, particularly the abrasion of diamond. Then, it was known that in each operation with the diamond grindstone, the diamond is worn out vigorously only when the operation is carried out for the special kinds of metals.

In research for the causes of this phenomenon, the inventor found that the above mentioned special kinds of metals are apt to react with diamond chemically. Further, when the operation is carried out for these special kinds of metals with CBN abrasive grind grindstone, the same phenomenon is shown.

Therefore, the inventior knew that if the metal which has large chemical affinity with the super abrasive grains are used in the dressing electrode and such electrode is slid while the abrasive grains are brought into contact with the metal, abrasion of the abrasive grains is accelerated because of the chemical reaction of the abrasive grains with the metal.

Finally, the inventor was confident that if the dressing electrode is formed of the above mentioned metal, an alloy containing mainly the metal, or a complicated material containing the metal and a non-metal material and the electrode is slid while it is pressed against the moving grindstone, the above mentioned disadvantages of the conventional electrolytic dressing methods can be eliminated.

4. Additionally, the inventor found the following things:

A conductive processing fluid is flown between the electrode and the grindstone. Then, a voltage should be applied there so as to provide a positive pole on the grindstone, such that at the contacting surface of the grindstone with the electrode, not only the chemical action and the electrolytic action but also an electro-discharge operation and mechanical operation can be performed simultaneously. Accordingly, these actions and operations cooperate on the ground surface of the grindstone to enable the effective trueing and dressing processes for the grindstone.

5. Therefore, the above mentioned problems of the conventional methods can be solved by the present invention.

5.1. Now, the composition of the method of dressing for the conductive grindstone related to the present invention will be explained below.

i) The dressing electrode used in this method is formed a metal which has large chemical affinity with the super abrasive grains of the grindstone, the alloy which contains mainly this metal or the complex material which contains this metal and a nonmetal material. Then, while this electrode is brought into contact with the ground surface of the grindstone with a predetermined pressure, this electrode is reciprocated in a direction which is perpendicular to the moving direction of the grindstone. On the other hand, the conductive processing fluid is applied to the gap between the electrode and the grindstone. Further, a voltage is applied there so as to provide the positive pole on the grindstone on the average during the dressing process.

ii) The contacting pressure applied to the grindstone by the dressing electrode is modified so as to correspond to the purpose of the dressing process and the material of the grindstone such as the kind of bond or the kind of abrasive grain.

Above all, modification of the pressure corresponding to the purpose of the dressing process (the dressing process is carried out for either progressing the grinding ability of trueing) is very important. Generally, for the progressing the grinding ability, the pressure should be small, while for the trueing, the pressure should be large.

When the small contacting pressure is applied to the grindstone by the dressing electode, the chemical action is not performed so much between the metal of the dressing electrode and the super abrasive grains. Thus, the super abrasive grains are not worn out so much. The mechanical operation is not performed so much because of this small pressure. On the other hand, the electrodischarge operation and the electrolytic action are performed well. Sludge and insulating products formed on the surface of the grindstone are removed efficiently with the electro-discharge operation and the mechanical operation. Accordingly, electrolytic action can be performed smoothly.

As a result, the bond metal can be melted quickly and the abrasive grains are not worn out so much, further, the surface of each abrasive grain can be pulverized with the shock of the electrodischarge. Therefore, the grindstone can be ground well to be very sharp.

On the other hand, when the large contacting pressure is applied to the grindstone by the dressing electrode, the chemical action caused by the dressing electrode is applied vigorously for the super abrasive grains. Thus, the abrasive grains are worn out so much. Additionally, the mechanical operation (scraping) is accelerated. Therefore, the trueing process is performed quickly. Further, the electro-discharge operation and the electrolyic action are not so large but remained surely, thus the trueing process can be carried out efficiently and surely.

5.2. The dressing system of the present invention basically comprises as follows.

i) The dressing electrode

For the dressing electrode, the metal having large chemical affinity with the super abrasive grains, particularly diamond and CBN (cubic boron nitoride) are used respectively. At least the of the dressing electrode which is brought into contact with the grindstone is formed of the metal, the alloy containing mainly the metal or the complicated material containing the metal and the non-metal material.

The examples of the metals having large chemical affinity with diamond and CBN are metal elements of 3A group, 4A group or 5A group. Particularly, the metal elements of 4A group such as Ti, Zr and Hf and the metal elements of 5A group such as V, Nb and Ta are used effectively.

For the alloy, the alloy comprising the above mentioned metals and the metal elements of 4 group or 5 group are used effectively.

For the complex material, the metal such as Ti and Nb containing the dispersed particles of super hard material such as diamond, CBN, WC, TiC, SiC, TiN, $Al_2O_3$, $Si_2N_4$ and the like are used. Alternatively, layer of sandwich arrangement of the thin plate of the above mentioned metal and the thin plate of the above mentioned super hard material can be used effectively.

ii) A mechanism for holding the dressing electrode

By this mechanism holding the dressing electrode, the electrode can reciprocate in the direction perpendicular to the moving direction of the grindstone. For example, in case of the rotating grindstone, the electrode reciprocates in the direction parallel to the rotating shaft of the grindstone. Further by this mechanism, the electrode can be transported toward the center of the rotating disk so as to be pressed against the ground surface of the grindstone. The dressing electrode is built in this mechanism and this mechanism is provided in this dressing system.

iii) A dressing power source

The voltage from this dressing power source is applied between the dressing electrode and the grindstone in order to generate the electrolytic action and electro-discharge operation. This dressing voltage is preferably in the range of 1-200 V. The dressing current is preferably in the range of 0.05-100 A. The power source is selected to be straight line form or voltage waveform such as sine waveform, rectangular waveform (pulse waveform is included), sawtooth waveform, distorted waveform (alternating current including harmonics) or a composite waveform formed of two more of the above mentioned waveforms. In every case, the average voltage is required not to be zero and the voltage is applied to provide the positive pole on the grindstone on average during the dressing process.

Normally, a direct current power source in full wave rectification can be used sufficiently. Particularly, when the electro-discharge operation is required to be accelerated, the power source should be the pulse wave or composite wave of the pulse wave with another wave.

6. According to the present invention, electrochemical action, chemical action, mechanical operation and electro-discharge operation are cooperated, the dressing process for the grindstones using super abrasive grains can be performed efficiently and surely. Particularly, the trueing process for the metal bond grindstones using super abrasive grains, which was impossible with the conventional method, can be carried out efficiently.

Further objects and advantages of the present invention will be apparent from the following description, reference being had to the accompanying drawing wherein preferred embodiments of the present invention are clearly shown.

BRIEF DESCRIPTION OF THE DRAWING

The single drawing figure shows a schematic construction of the dressing system according to the present invention.

DESCRIPTION OF THE PREFERRED EMBODIMENT

Now, the present invention will be described in more detail referring to the drawing.

The single figure shows schematically a representative construction of the present invention explained above. A grindstone 1' is fixed at the external peripheral portion of a disk-shaped grindstone 1. The disk-shaped grindstone 1 is secured, through a flange 3, to a spindle 2 which is supported to be held by a main body. The spindle 2 is driven so as to be rotated. One of the important characters of the present invention exists in a dressing electrode 4. This dressing electrode 4 is formed of a metal having large chemical affinity with super abrasive grains, an alloy containing mainly this metal or a complicated material containing this metal and a non-metal material.

A grindstone cover 7 is secured to the main body so as to cover the grindstone 1 and the dressing electrode 4. A holding device 5 for the dressing electrode 4 is mounted on the grindstone cover 7 through an insulating plate 6. The dressing electrode 4 is moved vertically and horizontally by a driving mechanism (not shown) in the directions indicated by arrows in this figure. In order to provide a predetermined contacting pressure against the grindstone 1', the dressing electrode 4 is moved in the direction of the radius direction of the grindstone 1. On the other hand, during a dressing process, the electrode 4 is reciprocated in the direction of the width (thickness) of the ground surface of the grindstone 1.

The grindstone 1 and the dressing electrode 4 are connected to a single power source 8. Then, a voltage is applied so as to provide a positive pole on the grindstone 1 on average during the dressing process. As explained above, the power source 8 can be selected to be direct current, alternating current, pulse wave or the composited wave thereof.

A conductive processing fluid is supplied in the direction indicated by an arrow 9 in this figure.

Examples illustrative of the advantages provided by the above mentioned dressing system related to the present invention over the prior art are presented below.

The dressing system shown in the figure and related to the present invention and conventional electrolytic dressing system are set on grinding plates respectively.

[EXAMPLE 1]

One combination comprises of one grindstone and one workpiece. Two combinations are prepared. The grindstones and the workpieces are fabricated to be duplicated respectively. Each workpiece was previously ground for ten hours. Then, one workpiece was dressed in the dressing system of the present invention. Another workpiece was dressed in the conventional dressing system for comparison. Conditions are shown below. For each grindstone which was already dressed, one pass creep feed grinding (one grinding in one-direction) is carried out with the cut depth of 0.4 mm and the feeding velocity of 0.100 mm/min. The width of the ground surface (the thickness) of the grindstone is 8 mm. Then, waviness of each ground surface in the direction of the thickness are measured by a surface measure.

"waviness" means the difference between the largest length deviated from the cut width of 0.4 mm and the smallest length deviated from it.

Additionally, each increasing value of current loaded by a motor during the one pass creep feed grinding is detected by an ammeter. The increased value of current means a difference of the current of the motor between in case that the grindstone is brought into contact with the workpiece and in case that the grindstone is moved away from the workpiece.

conditions i) the grindstone: metal bond diamond grindstone SD 100R 100M, $\phi 250 \times 8t \times 76.2$
(diamond grading: 100
grade: R
abrasive grains concentration: 100
diameter: 250 mm
thickness: 8 mm
inner diameter: 76.2 mm)

ii) the workpiece: sintered hard alloy (K 01 group) $10^t \times 100^w \times 200^l$
(thickness: 10 mm
width: 100 mm
length: 200 mm)

iii) the grinding method: plunge traverse method iv) the grinding direction of the workpiece: longitudinal v) the grinding conditions: the peripheral velocity of the grindstone: 1500 m/min,
the feeding velocity of the workpiece: 20 m/min,
the cut depth: 2 μm
the traverse width: 4 mm
the grinding hours: 10 hr vi) the material and size of the dressing electrode: (the method related to the present invention)
the material: Ti
the size:
thickness: 20 mm
length: 50 mm
height: 25 mm
(the conventional method) the material: carbon
the size:
It is the same as the size of the dressing electrode of the present invention.

vii) the movement of the dressing electrode: (the present invention)
the stroke of the reciprocating movement of the grindstone in the direction of the width of its ground surface (the stroke width): 30 mm
the cycle of the reciprocating movement thereof: 3 reciprocations/min
the feeding velocity of the grindstone in the direction of its radius (the descending velocity): 200 μm/hr
(the conventional method)
The gap between the dressing electrode and the grindstone is predetermined so as to be 300–350 μm. The location of the electrode is adjusted so that the gap has the above mentioned distance corresponding to the abrasion of the grindstone (about 100 μm/1 hr) by a manual operation with a screw every 30 min.

viii) the dressing current: 4 A in the both methods ix) the processing fluid:
a conductive grinding fluid
the resistivity: 115 Ω.cm (containing electrolyte)

x) the power source: a direct current power source
the maximum voltage: 50 V
the maximum current: 12 A The results of the above comparison are as follows;

1. By the method related to present invention, the waviness is smaller than 3 μm, while by the conventional method, the waviness is 315 μm. As appears from this, it will be found that the dressing method related to the present invention is an extremely progressed method which prevents the "geometric distortion" of the grindstone, comparing the conventional method.

2. The increasing value of the current loaded by the motor during the one pass creep feed grinding which is carried out at the last of the operation is 1.6 A in the method related to present invention, while it is 2.0 A in the conventional method.

It is concluded that on the condition of the same dressing current, the method related to the present invention is more progressed in the grinding ability for the grindstone than the conventional method.

[EXAMPLE 2]

Four combinations of untreated workpieces and metal bond CBN grindstones are prepared. The four grindstones are fabricated so as to be duplicated each other. Then, the three types of dressing processes related to the present invention (three types of dressing electrodes) and an electrolytic dressing process related to the conventional method where the dressing electrode is brought out of contact with the grindstone are carried out respectively for predetermined hours for the four grindstones.

Between creep feed grinding before the dressing process and creep feed grinding after the dressing process, there are differences of the cut depth of the creep feed grinding for the four grindstones respectively. Each difference means the decreased amount of the radius of each grindstone or the abrasion loss of each grindstone. Then, the differences are compared.

conditions i) the grindstone: metal bond CBN grindstone B 100R 100M, $\phi 250 \times 1.5^t \times 76.2$ ii) the material and size of the dressing electrode: (the present invention)
the material:
(i) Ti (ii) Nb
(iii) Ti containing dispersed CBN particles (grading 60)
the size:
thickness: 8 mm
length: 40 mm
height: 30 mm
(the conventional method) the material: (iv) carbon
the size:
It is the same as the size of the dressing electrode of the present invention.
iii) the movement of the dressing electrode: (the present invention)
the stroke width: 11.5 mm
the cycle: 3 reciprocations/min
the descending velocity: 300 μm/hr
(the conventional method)
The gap between the dressing electrode and the grindstone is predetermined so as to be 300 μm.
iv) the peripheral velocity of the grindstone: 1500 m/min,
v) the dressing current: 1 A
the dressing hours: 0.5 hr
vi) the processing fluid:
a conductive grinding fluid
resistivity: 115 Ω.cm (containing electrolyte)
vii) the power source; a direct current power source
the maximum voltage: 50 V
the maximum current: 5 A
The result of the above comparison are as follows;
The abrasion losses of the four grindstones:
(the present invention)
the dressing electrode
(i): 42 μm
(ii): 46 μm
(iii): 57 μm
(the conventional method)
the dressing electrode (iv): 29 μm.

As appears from the above results, it will be found that the method related to present invention is more progressed in the grinding ability for the grindstone than the conventional method.

[EXAMPLE 3]

Four metal diamond grindstones are decentering on purpose with the length of 170 μm and set on flat grinding plates respectively. Then, the three types of dressing processes related to the present invention (three types of dressing electrodes) and an electrolytic dressing process related to the conventional method where the dressing electrode is brought out of contact with the grindstone are carried out respectively. Each decentering length after the dressing process and each change of the dressing current are measured. Then, as for the trueing ability for the decentering (eccentricity) of the grindstone, the method of the present invention and the conventional method are compared.

Each decentering length is measured by a dial gage and each dressing current change is known by measuring the dressing current at the start of the dressing process and that at the end of the dressing process with an ammeter.

conditions i) the grindstone: metal bond diamond grindstone SD 400R 100M, $\phi 250 \times 1.5^t \times 76.2$
ii) the material and size of the dressing electrode: (the present invention)
the material:
(i) Ti
(ii) V
(iii) Nb containing dispersed diamond particles (grading 60)
the size:
thickness: 8 mm
length: 40 mm
height: 30 mm
(the conventional method) the material: (iv) carbon
the size:
It is the same as the size of the dressing electrode of the present invention.
iii) the movement of the dressing electrode:
(the present invention)
the stroke width: 11.5 mm
the cycle: 3 reciprocations/min
the descending velocity: 1500 μm/hr
(the conventional method) the gap between the dressing electrode and the grindstone is predetermined so as to be 100–270 μm (this value is modified due to eccentricity)
iv) the decentering length before dressing: 170 μm
v) the peripheral velocity of the grindstone: 1500 m/min,
iv) the dressing current: 2 A
the dressing hours: 0.5 hr
vii) the processing fluid:
a conductive grinding fluid
the resistivity: 115 Ω.cm (containing electrolyte)
The results of the above experiments are as follows;
1. the decentering lengths after the dressing process:
(the present invention)
the dressing electrode
(i): 9 μm
(ii): 26 μm
(iii): 3 μm
(the conventional method)
the dressing electrode (iv): 125 μm.

As appears from the above results, it will be found that the dressing system related to the present invention is more progressed in the trueing ability than the conventional electrolytic dressing system.

2. Each change of the current during the dressing process:
(the method related to the present invention) zero (current is 2 A to be constant)
(the conventional method) from 2 A at the start of the dressing process to 0.5 A at the end of the dressing process As appears from the above results, it will be found as follows; In the dressing process of the present invention, the trueing process can be performed constantly while the trueing ability can be kept highly. On the other hand, in the dressing process of the conventional method, the trueing ability is lowered as time is passed.

Although the above examples are explained in case of the dressing process for the disk-shaped grindstone, it is needless to say that the dressing process of the present invention can be applied to a blade saw-shaped grindstone. In this case, for example, dressing electrodes are disposed on the both sides so as to be symmetric with respect to the center of the reciprocating movement of the blade saw. Then, the electrodes are reciprocated in the direction which is perpendicular to the reciprocating movement of the blade saw (the direction of the thickness of the blade saw) and are pressed with a predetermined pressure in the direction of the blade height.

While preferred embodiments have been described, it is apparent that the present invention is not limited to the specific embodiments thereof.

What is claimed is:

1. A method of dressing a conductive grindstone having super abrasive grains, said method comprising:

reciprocating a dressing electrode while said dressing electrode contacts a surface of said conductive grindstone with a predetermined pressure, wherein said dressing electrode is formed of a metal having a large chemical affinity with said super abrasive grains, an alloy containing said metal or a complex material containing said metal and a non-metal material, said metal being selected from the group consisting of Ti, Zr, Hf, V, Nb and Ta;

applying a voltage between said dressing electrode and said conductive grindstone so as to provide a pole on said conductive grindstone, said pole being on average positive during the dressing process; and applying a conductive processing fluid to the portion of said dressing electrode contacting said conductive grindstone during the dressing process.

2. A method of dressing a conductive grindstone according to claim 1, wherein said dressing electrode is reciprocated in a direction perpendicular to the moving direction of said conductive grindstone.

3. A dressing system for a conductive grindstone having super abrasive grains, said system comprising:

a dressing electrode formed of a metal having a large chemical affinity with said super abrasive grains, an alloy containing said metal or a complex material containing said metal and a non-metal material, said metal being selected from the group consisting of Ti, Zr, Hf, V, Nb and Ta;

a mechanism which holds said dressing electrode and presses said dressing electrode to a peripheral surface of said of said conductive grindstone with a predetermined pressure and which reciprocates said dressing electrodes; and a dressing power source, from which a voltage is applied between said dressing electrode and said conductive grindstone so as to provide a positive pole on said conductive grindstone, said pole being on average positive during the dressing process.

4. A dressing system for a conductive grindstone according to claim 3, wherein said dressing electrode is reciprocated in a direction perpendicular to the moving direction of said conductive grindstone by said mechanism.

5. A dressing electrode for a conductive grindstone having super abrasive grains, said electrode comprising: a portion which contacts said conductive grindstone during a dressing process, wherein at least said portion is formed of a metal having a large chemical affinity with said super abrasive grains, an alloy containing said metal or a complex material containing said metal and a non-metal material, said metal being selected from the group consisting of Ti, Zr, Hf, V, Nb and Ta.

* * * * *